United States Patent [19]

Müller

[11] Patent Number: 4,541,824

[45] Date of Patent: Sep. 17, 1985

[54] APPARATUS FOR CHANGING THE DIRECTION OF MOVEMENT OF STREAMS OF PAPER SHEETS AND THE LIKE

[75] Inventor: Hans Müller, Zofingen, Switzerland

[73] Assignee: Grapha-Holding AG, Hergiswil, Switzerland

[21] Appl. No.: 569,773

[22] Filed: Jan. 10, 1984

[30] Foreign Application Priority Data

Jan. 14, 1983 [CH] Switzerland ..... 194/83

[51] Int. Cl.[4] ..... B31B 1/00

[52] U.S. Cl. ..... 493/29; 198/371; 198/435

[58] Field of Search ..... 493/29; 198/371, 435, 198/603, 607

[56] References Cited

U.S. PATENT DOCUMENTS 4,119,193 10/1978 Smith ..... 198/371
4,284,187 8/1981 Kramer ..... 198/435

FOREIGN PATENT DOCUMENTS 273646 5/1914 Fed. Rep. of Germany .
211226 7/1966 Sweden .
820731 9/1959 United Kingdom .

*Primary Examiner*—Leon Gilden
*Attorney, Agent, or Firm*—Peter K. Kontler

[57] ABSTRACT

A continuous or elongated stream of partially overlapping folded paper sheets is subdivided into shorter streams on the upper reach of a first endless belt or chain conveyor which can deliver the foremost shorter stream onto the upper reach of a second endless belt or chain conveyor or onto the upper reach of a first endless direction reversing conveyor, depending upon the position of a first switch which is pivotably mounted between the first and second belt or chain conveyors. A second direction reversing conveyor is mounted downstream of the second chain or belt conveyor and can receive a shorter stream from the second belt or chain conveyor by way of a second switch which is moved to a different position so as to prevent further transfer of sheets onto the second direction reversing conveyor as soon as the latter receives a complete shorter stream. The directions of travel of the direction changing conveyors are then reversed so that each of these conveyors can deliver the respective shorter stream onto the upper reach of a further conveyor or onto the upper reaches of two discrete further conveyors. At the same time, the first belt or chain conveyor delivers a shorter stream over the first switch and onto the second belt or chain conveyor while the leader of the continuous or longer stream advances onto the first belt or chain conveyor close to the first switch. The second switch can perform the function of a bridge over which a shorter stream can advance from the second reversing conveyor onto the further conveyor.

6 Claims, 5 Drawing Figures

APPARATUS FOR CHANGING THE DIRECTION OF MOVEMENT OF STREAMS OF PAPER SHEETS AND THE LIKE

BACKGROUND OF THE INVENTION

The present invention relates to a method of and to an apparatus for changing the direction of movement of successive streams of sheets which consist of paper or the like, especially to a method of and to an apparatus for changing the direction of movement of streams which consist of partially overlapping imprinted paper sheets.

Commonly owned Swiss patent application Ser. No. 469,925 filed Feb. 25, 1983 by Heinz Linder for "Method and apparatus for transporting and storing paper sheets and the like" discloses and apparatus wherein a continuous scalloped stream of partially overlapping paper sheets is subdivided into long discrete streams each of which is temporarily stored between the convolutions of an elastic band which is coiled around a rotary core so that each stored stream forms an elongated helix whose convolutions are disposed between the neighboring convolutions of the band. The continuous stream of sheets is supplied by a folding machine. In order to ensure that the sheets which are withdrawn from temporary storage will be in optimum positions for further processing (e.g., in a gathering machine), the apparatus of Ser. No. 469,925 comprises means for convoluting successive discrete streams onto a second core and for thereupon withdrawing successive streams from the second core so that the sequence of sheets in each of the thus treated streams is the same as in the continuous stream.

A drawback of apparatus which employ direction reversing means in the form of cores and elastic bands is that they occupy a substantial amount of space. Therefore, such apparatus can be put to use only in certain types of plants where the required space is available or where the provision of required space is warranted in view of the capacity of the plant or for other reasons.

OBJECTS AND SUMMARY OF THE INVENTION

An object of the invention is to provide a novel and improved apparatus for changing the direction of movement of discrete streams of paper sheets or the like in a small space and at the rate at which such sheets issue from a printing, folding or other sheet supplying machine.

Another object of the invention is to provide an apparatus wherein the reversal in the direction of movement of successive streams of sheets does not require resort to a rotary core and a band which is to be convoluted onto or paid out by the core.

A further object of the invention is to provide the apparatus with novel and improved means for simultaneously reversing the direction of several discrete streams of paper sheets or the like.

An additional object of the invention is to provide the apparatus with novel and improved means for temporarily storing discrete streams of paper sheets or the like prior to reversal of their direction of movement from temporary storage to one or more gathering or other consuming machines.

A further object of the invention is to provide a novel and improved method of reversing the direction of a short or long series of discrete streams of partially overlapping sheets consisting of paper or the like.

An additional object of the invention is to provide an apparatus which can reverse the direction of short or long streams of sheets with the same facility and with the same degree of accuracy.

Another object of the invention is to provide the apparatus with novel and improved means for transporting and/or diverting a succession of streams of sheets to the direction reversing station or stations.

Still another object of the invention is to provide the apparatus with novel and improved means for removing freshly reversed streams of sheets from the respective station or stations.

Another object of the invention is to provide a novel method of and a novel apparatus for turning a succession of elongated streams of paper sheets about the central vertical axes of such streams.

One feature of the invention resides in the provision of an apparatus for altering the direction of movement of a series of streams of paper sheets or the like, especially a series of so-called scalloped streams wherein each next-following sheet partially overlaps the preceding sheet. The apparatus comprises a first transporting unit which serves to advance successive streams of the series in a first direction and includes spaced-apart front and rear sections, a second transporting unit which serves to advance streams of sheets in a second direction substantially counter to the first direction, first and second direction reversing conveyors which are respectively located downstream of the rear and front sections, as considered in the first direction, a first switch which is disposed between the front and rear sections of the first transporting unit and is movable between a first position in which a stream of sheets if free to advance thereover and from the rear onto the front section of the first transporting unit and a second position in which a stream of sheets is free to advance thereover from the rear section onto the first direction reversing conveyor, a second switch which is movable between a first position in which it prevents the transfer of streams of sheets from the front section onto the second direction reversing conveyor and a second position in which a stream is free to advance thereover from the front section onto the second direction reversing conveyor, and reversible drive means for the direction reversing conveyors. The drive means is arranged to drive the conveyors in the first direction in the second positions of the switches and to drive the conveyors in the second direction (to thereby enable the conveyors to deliver streams of sheets to the second transporting unit) in the first positions of the switches.

The second switch can be connected to the front end portion of the first section of the first transporting unit or to an end portion of the second direction reversing conveyor which is adjacent to but spaced from the front section of the first transporting unit. The second transporting unit can comprise first and second sections which respectively receive streams of sheets from the first and second direction reversing conveyors in the first positions of the respective switches. The length of the front section of the first transporting unit and of each direction reversing conveyor can equal or approximate the length of a stream. The apparatus can further comprise means (e.g., a reversible electric motor or a combination of two reversible electric motors or fluid-operated motors) for simultaneously moving the first and second switches between their first and second positions.

Another feature of the invention resides in the provision of a method of altering the direction of movement of a series of streams of paper sheets or the like, especially a series of scalloped streams wherein the neighboring sheets partially overlap each other. The method comprises the steps of transporting successive streams of the series in a first direction along a first path, transferring the two foremost streams from the first path into discrete second paths and advancing the transferred streams in the first direction along the respective second paths, advancing the transferred streams in a second direction at least substantially counter to the first direction from the respective second paths into at lease one third path, transporting the streams along the third path in the second direction, and transporting the next-following streams of the series in the first direction along the first path in the course of the transferring and advancing steps so that the next two foremost streams of the series are ready for transfer into the respective second paths not later than on completion of the second advancing step.

The second paths can be at least substantially parallel to the first path and the latter may but need not be at least substantially parallel to the third path. The length of each advancing step preferably equals or approximates the length of a stream.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
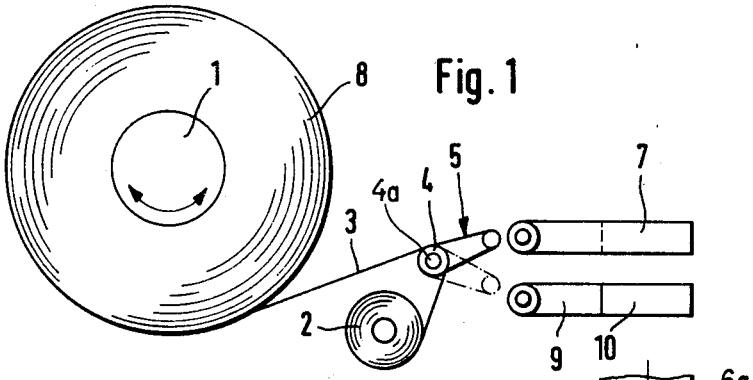
FIG. 1 is a schematic elevational view of a device for temporary storage of sheets which can receive sheets from or which can deliver sheets to the improved direction altering apparatus.
Figure 2:
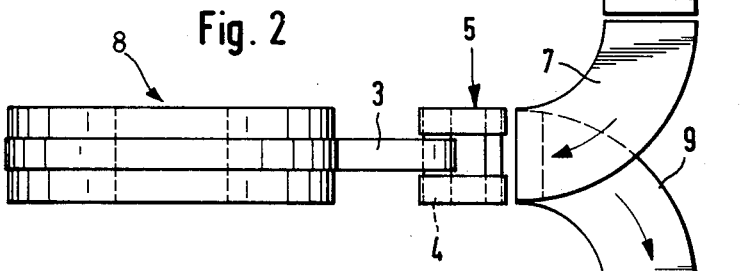
FIG. 2 is a schematic plan view of the structure which is shown in FIG. 1.

Referring first to FIGS. 1 and 2, there is shown a device which can temporarily store an elongated stream of a series of shorter streams of partially overlapping imprinted paper sheets which are supplied by a suitable source (e.g., a sheet folding machine) in the direction of arrow *6a* shown in FIG. 2. The sheets are stored on a rotary core 1 which is connected with one end portion of an elongated elastic flexible element 3 (hereinafter called band). The other end portion of the band 3 is connected to a second core 2 which can be driven to rotate in a clockwise direction to thereby collect the band when the latter is being paid out by the core 1. The band 3 is trained over a guide roller 4 whose shaft *4a* constitutes a pivot for a switch 5 movable between the solid-line and phantom-line positions of FIG. 1. When in the solid-line position, the switch 5 permits a scalloped stream of partially overlapping paper sheets to advance from the aforementioned source, with the upper reach of an endless belt or chain conveyor 6 (as indicated by the arrow *6a*), along a deflector 7 which constitutes an orientation changing device by causing successive sheets of the stream to change their direction of movement by 90°, over the switch 5 (which can constitute or include an endless belt conveyor), and onto that portion of the band 3 which extends between the guide roller 4 and the growing roll 8 on the core 1 (at such time, the core 1 is driven to rotate in a clockwise direction and the core 2 is free to rotate in a counterclockwise direction, as viewed in FIG. 1) so that the stream of partially overlapping sheets forms a helix whose convolutions are disposed between the neighboring convolutions of the band 3 and form therewith the growing roll 8.

When the stream of partially overlapping sheets is to be withdrawn from storage (roll 8), the switch 5 is pivoted to the phantom-line position of FIG. 1 and the core 2 is driven to rotate in a clockwise direction (at such time, the core 1 is free to rotate in a counterclockwise direction) so that the band 3 delivers successive increments of the stored stream onto the switch 5 and the sheets advance onto a second deflector 9 which changes the orientation of successive sheets by 90° and delivers the thus reoriented sheets onto the upper reach of an endless belt or chain conveyor 10 serving to transport the sheets to a further processing station, e.g., to a gathering machine. It will be readily appreciated that, in the device of FIGS. 1 and 2, the rearmost sheet of the stream which is temporarily stored on the core 1 will become the foremost sheet of the stream which is thereupon advanced toward and onto the conveyor 10. Thus, and if it is desirable or necessary that the sheets of the stream which is supplied by the source be delivered to the next processing machine in the same sequence in which they issue from the source, it is necessary to reverse the direction of movement of sheets which form the stream. Such reversal of the direction of movement can take place ahead of the conveyor 6 or downstream of the conveyor 10. Alternatively, the conveyor 6 or 10 can constitute or form part of an apparatus which is capable of reversing the direction of movement of the stream in the just described manner, namely so that the foremost sheet of the stream issuing from the source will be the foremost sheet of the stream which reaches the processing machine.

Figure 3:
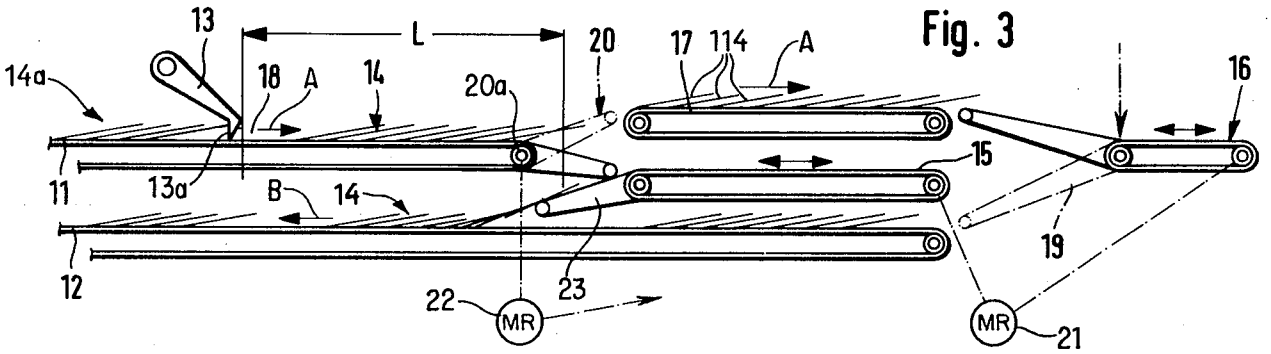
FIG. 3 is a schematic elevational view of an apparatus which embodies one form of the invention, the parts of the apparatus being shown in positions they assume upon completion of the advancement of two streams of sheets from the direction reversing conveyors onto the second transporting unit.
Figure 4:
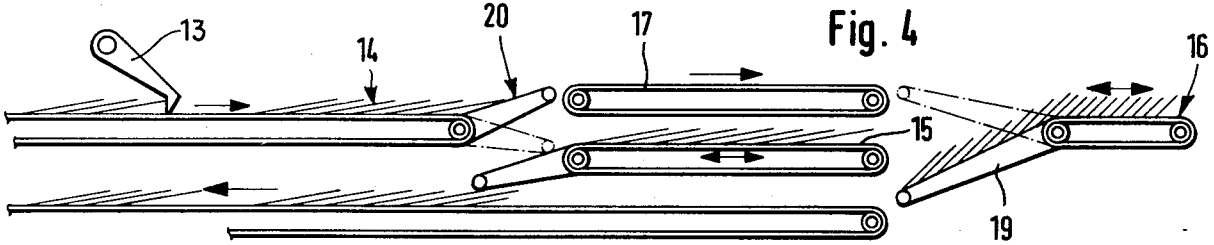
FIG. 4 illustrates the structure of FIG. 3 but with the parts in positions they assume upon completion of the transfer of two streams of sheets from the first transporting unit onto the direction reversing conveyors.

In the apparatus of FIGS. 3 and 4, two endless belt or chain conveyors 11 and 17 respectively constitute the rear and front sections of a first transporting unit which serves to deliver a series of discrete streams 14 of partially overlapping paper sheets 114 from the conveyor 10 of FIGS. 1 and 2. The upper reaches of the conveyors 11 and 17 are but need not be disposed at different levels, and these conveyors are disposed at a level above a further endless belt or chain conveyor 12 which constitutes a second transporting unit and delivers successive discrete streams 14 to a processing or consuming machine, not shown in FIGS. 3 and 4. If the conveyor 11 receives sheets 114 from the source, the conveyor 12 delivers streams 14 of sheets to the conveyor 6 of FIGS. 1 and 2.

The conveyor 11 cooperates with an intercepting device 13 which is movable into and from the path of oncoming sheets 114 at predetermined intervals so as to subdivide a relatively long stream 14A into a succession of discrete shorter streams each having a length L. The length of each discrete stream 14 need not be less than one meter and need not exceed five meters. The intercepting device 13 is responsive to signals which are generated by a sheet counter or the like (not shown) to move to the illustrated position at intervals which are necessary to subdivide the longer or continuous stream 14A into discrete shorter streams 14 each of which contains a predetermined number of partially overlapping sheets 114. The gap between two successive streams 14 on the upper reach of the conveyor 11 is indicated at 18.

The clearance between the rear end portion of the front conveyor or section 17 and the front end portion of the rear conveyor or section 11 of the first transporting unit accommodates a first switch 20 which is pivotable at 20*a* and is movable between a first position (indicated in FIG. 3 by phantom lines) and a second position (indicated in FIG. 3 by solid lines). The switch 20 can include or constitute an endless belt or chain conveyor which allows or causes successive sheets 114 of the foremost stream 14 on the conveyor 11 to advance onto the upper reach of the conveyor 17 when a suitable motor 22 (e.g., a reversible electric motor or a reversible fluid-operated motor) is actuated to move the switch 20 to the phantom-line position of FIG. 3 (i.e., to the solid-line position of FIG. 4). When the switch 20 is caused to assume the solid-line position of FIG. 3 (i.e., the phantom-line position of FIG. 4), the foremost discrete stream 14 can advance from the upper reach of the conveyor 11, over the switch 20 and onto the upper reach of a first direction reversing conveyor 15 which is located downstream of the conveyor 11, as viewed in the direction (arrows A) of advancement of sheets 114 with the upper reaches of the conveyors 11 and 17. The length of the conveyors 15 and 17 preferably equals or approximates the length L of a stream 14. The conveyor 15 is an endless belt or chain conveyor which can be driven in the direction of arrows A or in the opposite direction (arrow B) which is the direction of movement of the upper reach of the conveyor 12 of the second transporting unit. The means for driving the conveyor 15 in the selected direction includes a reversible electric or other motor 21 of any suitable design.

The apparatus of FIGS. 3 and 4 further comprises a second switch 19 which forms part of a second direction reversing conveyor 16 located downstream of the conveyor 17, as viewed in the direction of arrow A, and having an effective length which preferably equals or approximates the length L of a stream 14. When moved to the solid-line position of FIG. 3 (i.e., to the phantom-line position of FIG. 4), the switch 19 allows a stream 14 to advance from the conveyor 17 onto the conveyor 16. If the switch 19 is thereupon moved from the solid-line to the phantom-line position of FIG. 3 (i.e., from the phantom-line to the solid-line position of FIG. 4), the conveyor 16 can deliver a stream 14 toward and onto the rear end of the conveyor 12. The means for driving the conveyor 16 in the direction of arrow A or B comprises the aforementioned motor 21; however, it is equally within the purview of the invention to provide discrete reversible motors for the two direction reversing conveyors 15 and 16. It will be noted that, when the switch 19 assumes its first position (shown in FIG. 3 by phantom lines), it prevents the transfer of a stream 14 of sheets 114 from the conveyor 17 onto the conveyor 16.

The means for driving the conveyors 11, 12 and 17 at a constant speed is not specifically shown in the drawing. Each of the conveyors 11, 15, 16, 17 can comprise a single endless chain or belt or two or more endless chains or belts which are disposed in parallel vertical planes. The intercepting device 13 is movable to and from the operative position of FIG. 3 in synchronism with the operation of other parts of the machine or production line in which the improved apparatus is put to use. For example, the pallet 13*a* of the intercepting device 13 can descend toward the upper reach of the conveyor 11 for a short interval of time during each cycle of the machine which supplies sheets to the conveyor 11 or during each cycle of the machine which receives streams 14 of sheets 114 from the conveyor 12. The switches 19 and 20 are or can be actuated at regular intervals (e.g., once during each cycle of the machine which receives streams 14 of partially overlapping sheets 114) to move between their respective first and second positions.

If the switches 20 and 19 are pivoted to the solid-line positions of FIG. 3, the stream 14 which is supported by the upper reach of the conveyor 17 is free to advance over the switch 19 and onto the conveyor 16. At the same time, the stream 14 which is supported by the upper reach of the conveyor 11 is free to advance over the switch 20 and onto the conveyor 15. At such time, the motor 21 drives the conveyors 15 and 16 in the direction which is indicated by the arrows A. The motor 22 is thereupon caused to move the switches 20 and 19 to the solid-line positions of FIG. 4. At the same time, the motor 21 causes the conveyors 15 and 16 to advance their upper reaches in the direction which is indicated by the arrow B. Thus, the stream 14 which is supported by the conveyor 16 is free to advance over the switch 19 and onto the rear end portion of the conveyor 12, and the stream 14 which is supported by the upper reach of the conveyor 15 is free to advance over a fixed downwardly sloping conveyor 23 and onto the upper reach of the conveyor 12 ahead of the stream 14 which is being transferred from the conveyor 16. Thus, the upper reach of the conveyor 12 can simultaneously receive two discrete streams 14 whereby the two streams cannot interfere with one another because the length of the conveyor 16 at least approximates the length L of a stream 14.

Furthermore, and while the switches 20 and 19 are held in the solid-line positions of FIG. 4, the foremost stream 14 is free to advance from the front portion of the conveyor 11, over the switch 20, and onto the upper reach of the conveyor 17. At the same time, the intercepting device 13 is held in raised position so that the leader of the stream 14A can advance toward the front end of the conveyor 11 to form thereon a fresh stream 14 in response to return movement of the intercepting device 13 to its operative position. The switches 20 and 19 are returned to the solid-line positions of FIG. 3 as soon as the transfer of two discrete streams 14 from the conveyors 15, 16 onto the conveyor 12 is completed.

The aforedescribed series of steps is then repeated by causing two discrete streams 14 to respectively advance from the conveyors 11, 17 onto the conveyors 15, 16, by causing the switches 20, 19 to move to the positions of FIG. 4 and by simultaneously causing the motor 21 to drive the conveyors 15, 16 in directions (arrow B) to transfer two streams 14 onto the conveyor 12, and so forth.

Figure 5:
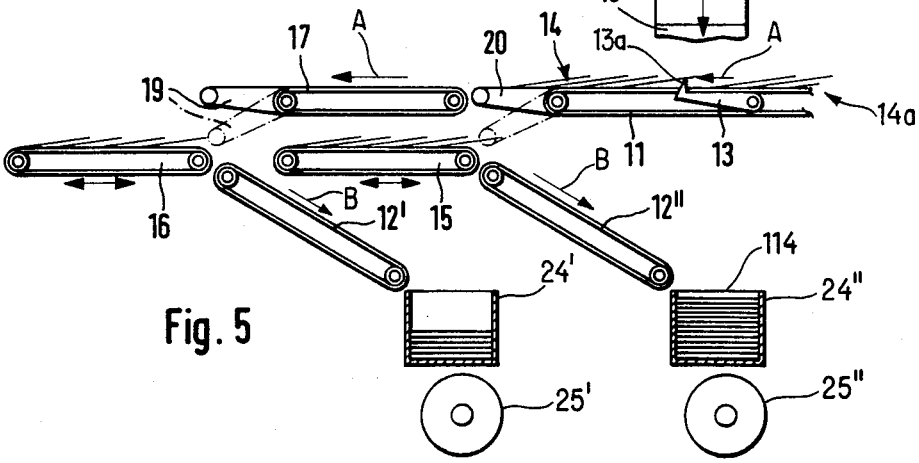
FIG. 5 is a schematic elevational view of a second apparatus wherein the second transporting unit comprises two discrete sections and the second switch is movably connected with the front end portion of the front section of the first transporting unit.

All such parts of the apparatus of FIG. 5 which are identical with or clearly analogous to the corresponding parts of the apparatus of FIGS. 3 and 4 are denoted by similar reference characters. The second transporting unit of the apparatus which is shown in FIG. 5 comprises two discrete sections in the form of downwardly sloping endless belt or chain conveyors 12' and 12'' serving to respectively deliver sheets into two discrete magazines 24', 24'' of a gathering machine. The magazines 24', 24'' respectively discharge successive sheets into the range of two sheet opening devices 25', 25'' (schematically indicated by circles) which treat the sheets in a manner as disclosed, for example, in commonly owned U.S. Pat. No. 4,085,927 granted Apr. 25, 1978 to Hans Müller for "Apparatus for gathering folded sheets in bookbinding machines".

Another difference between the two apparatus is that, in FIG. 5, the second switch 19 is pivotally connected to the front end of the conveyor 17 and can be said to constitute a component part of such conveyor. In the solid-line position of FIG. 5, the switch 19 prevents the transfer of a stream 14 of sheets from the conveyor 17 onto the conveyor 16. When moved to the phantom-line position of FIG. 5, the switch 19 enables the conveyor 17 to deliver a stream 14 onto the conveyor 16, and such stream is delivered directly onto the downwardly sloping upper reach of the section or conveyor 12' of the second transporting unit as soon as the switch 19 reassumes the solid-line position of FIG. 5. The mode of operation of the switch 20 is the same as described in connection with FIGS. 3 and 4. The conveyor 23 of FIGS. 3 and 4 is not needed in the apparatus of FIG. 5 because the right-hand end of the direction reversing conveyor 15 can deliver sheets of a complete stream 14 directly onto the downwardly sloping upper reach of the conveyor 12''. The intercepting device 13 is pivotably mounted between the upper and lower reaches of the conveyor 11; to this end, the conveyor 11 can comprise several endless belts or chains and the pallet **13*a* of the device 13** is pivotable in a plane between two neighboring belts or chains.

The mode of operation of the apparatus of FIG. 5 is analogous to that of the apparatus which is shown in FIGS. 3 and 4. Thus, when the switches 19 and 20 are held in the solid-line positions of FIG. 5, the switch 19 constitutes a forward extension of the main portion of the conveyor 17 which receives a stream 14 from the upper reach of the conveyor 11 by way of the switch 20. At the same time, the leader of the stream 14A is free to advance toward the front end of the conveyor 11 until the pallet **13*a* of the intercepting device 13 is lifted to that the thus obtained fresh stream 14 on the conveyor 11 is separated from the leader of the remaining portion of the stream 14A. At the same time, the conveyors 15 and 16 are driven in the directions indicated by arrows B so that the streams 14 which are supported by their upper reaches are transferred onto the upper reaches of the respective conveyors 12', 12'' whence the sheets descend into the respective magazines 24', 24''. The directions of movement of the upper reaches of the conveyors 15, 16 are thereupon reversed (see the arrows A) and the switches 19, 20 are moved to the phantom-line positions of FIG. 5. This enables the stream 14 on the conveyor 17 to advance over the downwardly sloping switch 19 and onto the conveyor 16 while another stream 14 advances from the upper reach of the conveyor 11, over the switch 20 and onto the direction reversing conveyor 15. The motors 21 and 22 have been omitted in FIG. 5 for the sake of clarity. The cycle is then repeated by returning the switches 19, 20 to the solid-line positions of FIG. 5, by causing the conveyors 15, 16 to move their upper reaches in the direction indicated by the arrows B, by thereupon moving the switches 19, 20 to the phantom-line positions of FIG. 5 and by simultaneously changing the direction of movement of the upper reaches of the conveyors 15, 16 from B to A. The length of each of the conveyors 15, 16, 17 preferably equals or approximates the length of a stream 14. The same preferably (but not necessarily) applies for the length of the conveyors 12' and 12''. It is important to ensure that each of the conveyors 15, 16 and 17 can temporarily support a complete stream 14**.

The magazines 24', 24'' can be replaced by a single conveyor (e.g., the conveyor 6 or 10 of FIGS. 1 and 2) which can transport the sheets 114 to a further processing station at a desired distance from the conveyors or sections 12', 12'' of the second transporting unit.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for altering the direction of movement of a series of streams of paper sheets or the like, comprising a first transporting unit arranged to advance successive streams of said series in a first direction and including spaced-apart front and rear sections; a second transporting unit arranged to advance streams of sheets in a second direction substantially counter to said first direction; first and second direction reversing conveyors respectively located downstream of said rear and front sections, as considered in said first direction; a first switch disposed between said sections and movable between a first position in which a stream is free to advance thereover from said rear onto said front section and a second position in which a stream is free to advance thereover from said rear section onto said first conveyor; a second switch movable between a first position in which it prevents the movement of streams of sheets from said front section onto said second conveyor and a second position in which a stream is free to advance thereover from said front section onto said second conveyor; and reversible drive means for said conveyors, said drive means being arranged to drive said conveyors in said first direction in the second positions of said switches and to drive said conveyors in said second direction to thereby enable said conveyors to deliver streams of sheets to said second unit in the first positions of said switches.

2. The apparatus of claim 1, wherein said front section has a front end portion and said second switch is connected to the front end portion of said front section.

3. The apparatus of claim 1, wherein said second conveyor has an end portion adjacent to but spaced from said front section and said second switch is connected to the end portion of said second conveyor.

4. The apparatus of claim 1, wherein said second unit includes first and second sections which respectively receive streams of sheets from said first and second conveyors in the second positions of the respective switches.

5. The apparatus of claim 1 for altering the direction of movement of a series of streams each of which has a predetermined length, wherein said front section and each of said conveyors has a length at least approximating said predetermined length.

6. The apparatus of claim 1, further comprising means for simultaneously moving said switches between said first and second positions.

* * * * *